US009739065B1

(12) United States Patent
DeSalle et al.

(10) Patent No.: US 9,739,065 B1
(45) Date of Patent: Aug. 22, 2017

(54) RAIL TOP ATTACHMENT CLIP AND METHOD

(71) Applicant: BARRETTE OUTDOOR LIVING, INC., Egg Harbor City, NJ (US)

(72) Inventors: Michael Matthew DeSalle, Northfield, NJ (US); Christopher Michael Schneider, Mays Landing, NJ (US); Wayne Elbert Dixon, Chuckey, TN (US); Randall Lewis Reed, Morristown, TN (US)

(73) Assignee: BARRETTE OUTDOOR LIVING, INC., Egg Harbor City, NJ (US)

( * ) Notice: Subject to any disclaimer, the term of this patent is extended or adjusted under 35 U.S.C. 154(b) by 0 days.

(21) Appl. No.: 15/079,375

(22) Filed: Mar. 24, 2016

(51) Int. Cl.
*E04F 11/18* (2006.01)
*E04H 17/14* (2006.01)

(52) U.S. Cl.
CPC ..... *E04F 11/18* (2013.01); *E04F 11/1817* (2013.01); *E04H 17/14* (2013.01); *E04H 17/1417* (2013.01)

(58) Field of Classification Search
CPC ... E04F 11/18; E04F 11/1817; E04F 11/1836; E04F 2011/1868; Y10T 403/11; Y10T 403/1616; Y10T 403/1624; Y10T 403/7015; Y10T 24/30; Y10T 24/309; Y10T 24/304
USPC ..... 256/59, 65.01, 65.08, 66; 403/2, 13, 14, 403/353
See application file for complete search history.

(56) References Cited

U.S. PATENT DOCUMENTS 3,498,589 A 3/1970 Murdock
4,014,520 A 3/1977 Walters
4,334,671 A * 6/1982 De Guise ..... E04F 11/181 256/22
6,874,766 B2 * 4/2005 Curatolo ..... E04F 11/1817 256/59

(Continued)

FOREIGN PATENT DOCUMENTS

DE 2547424 A1 * 4/1977 ..... E01D 19/103
JP 2013036299 A 2/2013
KR 20030068598 A 8/2003

OTHER PUBLICATIONS

RDI at Deck Expressions.com, "Avalon aluminum Hand rail cap at Deck Expressions", Retrieved Jan. 8, 2016, http://www.deckexpressions.com/avalontoprailcapbyrdi/, 5 pages.

(Continued)

*Primary Examiner* — Josh Skroupa
*Assistant Examiner* — Cory B Siegert
(74) *Attorney, Agent, or Firm* — Maldjian Law Group LLC

(57) ABSTRACT

A railing attachment clip to couple a guardrail to a rail topper, the clip including left and right portions with respective surfaces contoured to match the guardrail and the rail topper, and a central portion laterally coupled to the left and right portion. The central portion separates the left and right portions by a fixed distance. The matching contoured surfaces determine a position of the railing attachment clip on the guardrail, and determine a position of the rail topper on the railing attachment clip. In some embodiments, the central portion is removed after the railing attachment clip is attached to the guardrail, but before the rail topper is attached to the railing attachment clip.

15 Claims, 16 Drawing Sheets

(56) References Cited

U.S. PATENT DOCUMENTS

| | | | | |
|---|---|---|---|---|
| 7,438,284 | B2 * | 10/2008 | McGinness | E04F 11/1812 256/59 |
| 7,543,802 | B2 * | 6/2009 | Petta | E04F 11/1812 256/59 |
| 7,731,160 | B2 | 6/2010 | Terrels et al. | |
| 7,744,065 | B2 * | 6/2010 | Terrels | E04F 11/181 256/19 |
| 8,167,275 | B1 | 5/2012 | Bizzarri et al. | |
| 2009/0065756 | A1 | 3/2009 | McGinness et al. | |
| 2011/0198552 | A1 * | 8/2011 | Umosella, III | E04F 11/1817 256/65.08 |
| 2016/0296009 | A1 * | 10/2016 | King | F16B 2/22 |

OTHER PUBLICATIONS

Deckorators, "CXT Colonial Style Railings", Retrieved Jan. 8, 2016, http://www.thedeckstoreonline.com/cxtcolonialstylerailings.html, 4 pages.

Sheridan Marine, "Screw Cover Clip-in Strips", Retrieved Jan. 8, 2016, http://www.sheridanmarine.com/product/screw-cover-clip-in-strips, 2 pages.

Alibaba, "Aluminum U Channel Glass Handrail Balcony Aluminum Railing", Retrieved Jan. 8, 2016, http://www.alibaba.com/product-detail/aluminum-u-channel-glass-handrail-balcony_60201401722.html, 13 pages.

* cited by examiner

800

RAIL TOP ATTACHMENT CLIP AND METHOD

FIELD OF THE INVENTION

Embodiments of the present invention, generally relate to railing systems and methods, and in particular relate to a rail top attachment clip that facilitates upgradable railing systems and methods to provide a customizable rail topper.

BACKGROUND

Railing systems are used extensively for a variety of functional purposes, e.g., as fencing to secure people, animals, and land, and to prevent entry into a specified area. Railing systems also may have aesthetic purposes, e.g., on decks and around yards, terraces, and gardens, etc. Railing systems often include at least one horizontal rail affixed to at least one vertical post, and optionally a plurality of balusters.

A variety of rail shapes exist to address functional and/or aesthetic preferences, e.g., a flat top, or a shape that includes hand-hold features, etc. In particular, one type of rail shape includes a lateral central crown and lengthwise edges and/or ridges, such that the rail resembles a loaf of some types of bread. Such a type of rail shape may be referred to as a "bread loaf" type shape.

Consumers sometimes want to change the look and feel of an installed railing system. Replacing the railing system or major portions of it is costly, inconvenient and time consuming. Upgrading the railing system (e.g., to change color or shape of rail toppings) is simpler, less costly, and thus more likely to be something that a consumer will do.

Traditionally, one method to upgrade a railing system is to screw a regular deck board onto an existing rail. However, this is not aesthetically pleasing since fasteners are exposed and visible.

Another traditional method to upgrade a railing system is to screw clips on top of a rail, then attach a regular deck board to the clips. However, clips by themselves on a rail have poor structural integrity, resulting in undesirable waving and bowing of the deck board. Any exposed clips will not be aesthetically pleasing.

Another drawback is that traditional upgrade methods require multiple components to change the look and feel of an installed railing system.

Therefore, there is a need for an improved railing system and method is needed to address the drawbacks of the traditional methods and systems.

SUMMARY

Embodiments in accordance with the present disclosure provide a system and method to rigidly but removably attach a rail topper to a guardrail, by use of a railing attachment clip. The railing attachment clip includes left and right portions with respective surfaces contoured to match the guardrail and the rail topper, and a central portion laterally coupled to the left and right portion. The central portion separates the left and right portions by a fixed distance. The matching contoured surfaces determine a position of the railing attachment clip on the guardrail, and determine a position of the rail topper on the railing attachment clip. In some embodiments, the central portion is removed after the railing attachment clip is attached to the guardrail, but before the rail topper is attached to the railing attachment clip.

According to an aspect of the present disclosure, a railing system having customizable rail topper is provided herein. The railing system includes an elongated upper rail, an elongated lower rail, and a plurality of balusters extending between the elongated upper rail and the elongated lower rail. The elongated upper rail includes an elongated core member, an attachment clip, and a rail topper member. The attachment clip includes a left side portion, a right side portion, and a middle portion. The left side portion includes a first concave portion, a first curved portion and a first edge portion. The right side portion includes a second concave portion, a second curved portion and a second edge portion. The middle portion connects the first concave portion of the left side portion with the second concave portion of the right side portion. The rail topper member includes an elongated central body having a pair of opposing side walls defining a channel to receive the elongated core member, the rail topper member having a central ridge portion, at least one left flange on left side wall, and at least one right flange on right side wall. The middle portion of the attachment clip is breakable, and the rail topper member is snap-fitted over the attachment clip after breaking the middle portion of the attachment clip. The central ridge portion of the rail topper member contacts an upper portion of the elongated core member. The left flange of the rail topper member engages with the first edge portion of the attachment clip and the right flange of the rail topper member engages with the second edge portion of the attachment clip to lock the rail topper member over attachment clip and the elongated upper rail.

According to another aspect of the present discourse, the railing system includes an elongated upper rail, an elongated lower rail, and a plurality of balusters extending between the elongated upper rail and the elongated lower rail. The elongated upper rail includes an elongated core member, an attachment clip, and a rail topper member. The attachment clip includes a left side flat portion, a right side flat portion, and a middle flat portion. The middle flat portion is connected to the left side flat portion through a first curved portion and is connected to the right side flat portion through a second curved portion. The rail topper member has an elongated central body having a rectangular top surface and a rectangular bottom surface. Each of the first curved portion and the second curved portion of the attachment clip includes mounting holes to receive fasteners and lock the attachment clip over the elongated upper rail. Each of the left portion and the right portion of the attachment clip includes mounting holes to receive fasteners and lock the rail topper member over attachment clip and the elongated upper rail.

According to another aspect of the present disclosure, a method to assemble a railing system is provided. The method includes fixing an attachment clip over an elongated core member. The attachment clip including a left side portion, a right side portion, and a breakable middle portion. The method further includes breaking the middle portion of the attachment clip, and snap fitting a rail topper member over the attachment clip to lock the rail topper member over the attachment clip and the elongated core member.

The railing system, disclosed by the present invention, can be advantageously combined with the traditional railing system to offer a completely different look to the railing. There is no need to replace the whole bay with a different railing system. It can be added easily to existing railing purchased previously by customers as retro-fit.

Further, the present invention advantageously provides a snug snap fit railing assembly and solves structural integrity issues of conventional railing systems. The attachment clip facilitates self-centering of the rail cover or rail topper onto the attachment clip. Further, the present invention provides contact of the rail topper on the railing system, as the middle portion of the clip is snapped off. The center of gravity of the rail topper is lowered, hence providing a more compact structural integrity, which is more immune to bending, bowing, and weathering.

Further, the present invention advantageously provides completely hidden screws and increases the aesthetic appearance of the railing system. Further, the railing system can be put on different types of railings and provides freedom to the customer in their choice. Furthermore, the rail topper is easily detachable and hence, people can easily upgrade or change their existing rail topper time and again, as per their convenience and choice.

The preceding is a simplified summary to provide an understanding of some aspects of embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The above and still further features and advantages of embodiments of the present invention will become apparent upon consideration of the following detailed description of embodiments thereof, especially when taken in conjunction with the accompanying drawings, and wherein.

To facilitate understanding, like reference numerals have been used, where possible, to designate like elements common to the figures.

DETAILED DESCRIPTION

As used throughout this application, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

Figure 1:
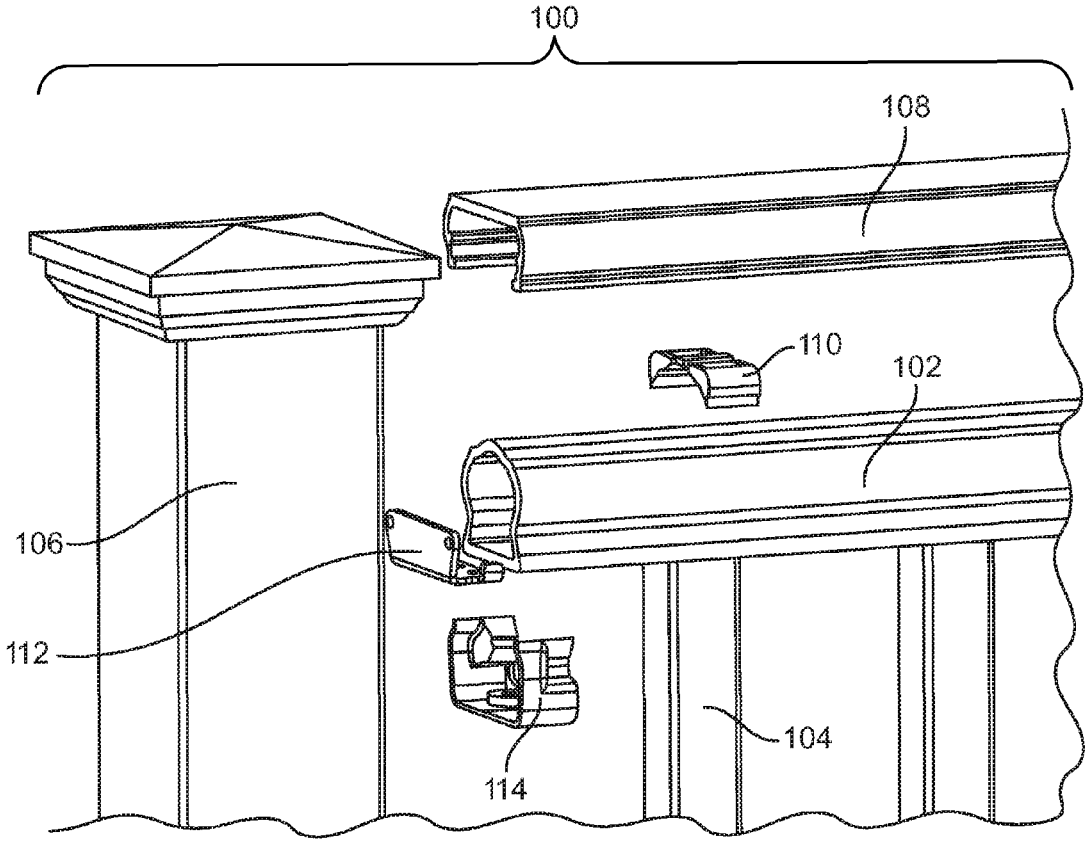
FIG. 1 illustrates an exploded view of a railing system, according to an embodiment of the present invention.

FIG. 1 illustrates an exploded view of railing system 100. In an embodiment of the present invention, railing system 100 includes an elongated rail 102 extending lengthwise and a plurality of balusters 104 extending vertically. The plurality of balusters 104 are connected to elongated rail 102 and extend downward to connect to another elongated rail (not shown in the FIG. 1). Railing system 100 may be installed between a pair of vertical support elements, including but not limited to posts, columns or walls. In one embodiment of the present invention, railing system 100 extends along the periphery of a deck, terrace, or other elevated structure. Those skilled in the art will appreciate that in other embodiments, railing system 100 may be used in any location where a railing installation is desired.

Elongated rail 102 includes an elongated core member. The core member is rigid load bearing component and provides internal strength to elongated rail 102. The core member may be formed of a material that distributes loads along the length of elongated rail 102, for example, aluminum, wood, plastic, iron etc. In an embodiment, elongated rail 102 has a shape of a bread loaf. Those skilled in the art will appreciate that in another embodiment of the present invention, elongated rail 102 may have different shape. In an embodiment, elongated rail 102 also couples to a load-bearing post 106. Post 106 may include a top element to enclose an interior of post 106, which may give post 106 a T-shape. In another embodiment, elongated rail 102 is free-standing without coupling to post 106.

Railing system 100 further includes a rail topper 108 and an attachment clip 110. Attachment clip 110 facilitates the snapping together of rail topper 108 and the elongated rail 102. Attachment clip 110 also facilitates the detaching of rail topper 108 and the elongated rail 102, however in some embodiments the detaching intentionally is difficult in order to help prevent an unintentional detachment. Detaching may be made difficult by a combination of stiffness of rail topper 108, stiffness of attachment clip 110 and an amount of movement needed to disengage them from each other. Attachment clip 110 is fixed over elongated rail 102 and rail topper 108 is snap-fitted over attachment clip 110.

Railing system 100 further includes a rail mounting bracket 112 and a mounting bracket cover 114. Rail mounting bracket 112 may be connected to post 106 as well as elongated rail 102 and serves to connect and to support elongated rail 102 with post 106. Mounting bracket cover 114 is connected to elongated rail 102. Mounting bracket cover 114 includes one or more inwardly facing ribs configured for connection with the elongated core member in a press fit. Rail mounting bracket 112 and mounting bracket cover 114 include a number of mounting holes and a number of fastener slots that connect them to post 106 and elongated rail 102.

Figure 2:
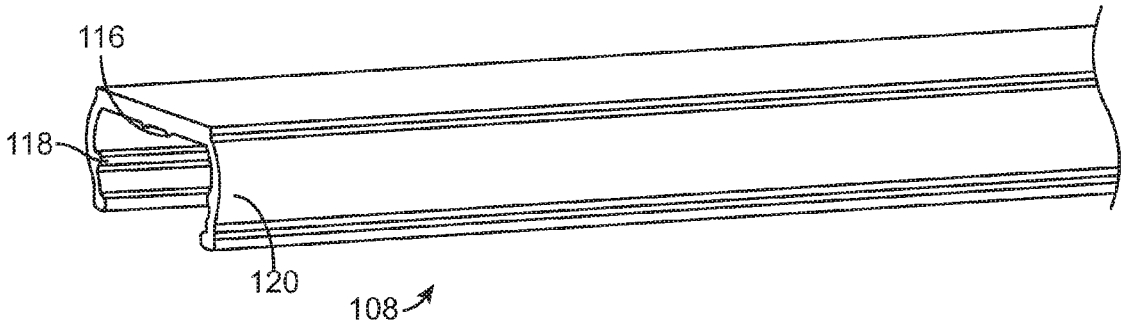
FIG. 2 illustrates a perspective view of a rail topper, according to an embodiment of the present invention.

FIG. 2 illustrates a perspective view of rail topper 108. In an embodiment of the present invention, the rail topper 108 is formed of a semi-flexible and resilient material (for example, plastic). In another embodiment of the present invention, the rail topper 108 may be formed of a rigid material. Rail topper 108 has a lower portion that detachably engages with the upper portion of attachment clip 110. Rail topper 108 provides a decorative cover to the railing system, and increases aesthetic appearance of the railing system. Rail topper 108 is detachable from attachment clip 110. This allows rail topper 108 to be replaced with another rail topper or a decorative cover without disassembling structural elements of the installed railing system (for example, elongated rail 102 or balusters 104). Rail topper 108 is removable, and can be replaced at any time with a different rail topper 108 having a different aesthetic appearance, and/or covers having different internal structures that may be specially adapted to house wires, conduits or other desired things being run within the railing. Further, rail topper 108 provides a substantial enclosure to attachment clip 110 and the core member of elongated rail 102 so that the core member and attachment clip 110 are not visible on the exterior of the railing system.

In the context of embodiments of the present invention, a semi-flexible and/or resilient material is a material that, when used for a rail topper 108 and given the dimensions of rail topper 108 (length and/or width), and size of a lip or other feature (e.g., horizontal surface 136) on a mounting attachment clip 110 used to secure mounted rail topper 108, provides enough flexibility to allow rail topper 108 to be manipulated by hand or by simple hand tools (e.g., a prying tool such as a screwdriver) onto and over the lip or similar feature such as horizontal surface 136. A similar amount of force and flexibility would be used to remove rail topper 108 if so desired. On the other hand, the semi-flexible and/or resilient material should not be so flexible that rail topper 108 would likely be dislodged upon ordinary use or ordinary contact not intended to dislodge rail topper 108, for example, contact such as placing a relatively small object on rail topper 108 (e.g., a flowerpot, a coffee cup, etc.), a person leaning against rail topper 108, and so forth.

In an embodiment of the present invention, rail topper 108 has an elongated and substantially inverted U-shaped structure, which includes a pair of opposing sidewalls that define a channel to receive the elongated core member. In an embodiment, rail topper 108 includes a center ridge portion 116, a left flange 118 on left sidewall, and a right flange 120 on right side wall. In another embodiment, rail topper 108 may have different internal structure. Rail topper 108 is capable of providing a decorative cover to elongated rail 102 and is configured to be fixed over attachment clip 110. Center ridge portion 116 may touch or contact elongated rail 102. The left and right flanges of rail topper 108 may engage with attachment clip 110 and facilitate locking of rail topper 108 over elongated rail 102.

In an embodiment, the left flange and right flange are spaced apart at a distance, which is slightly less than the width of the elongated core member. Further, the internal structure of rail topper 108 and attachment clip 110 is formed with resilient flexible flanges and ridges that snap over the exterior of attachment clip 110 and elongated rail 102, and firmly hold attachment clip 110 and elongated rail 102, without the use of fasteners or adhesives. The snapping connection between rail topper 108 and elongated rail 102 allows rail topper 108 to be readily attached and removed.

Figure 3:
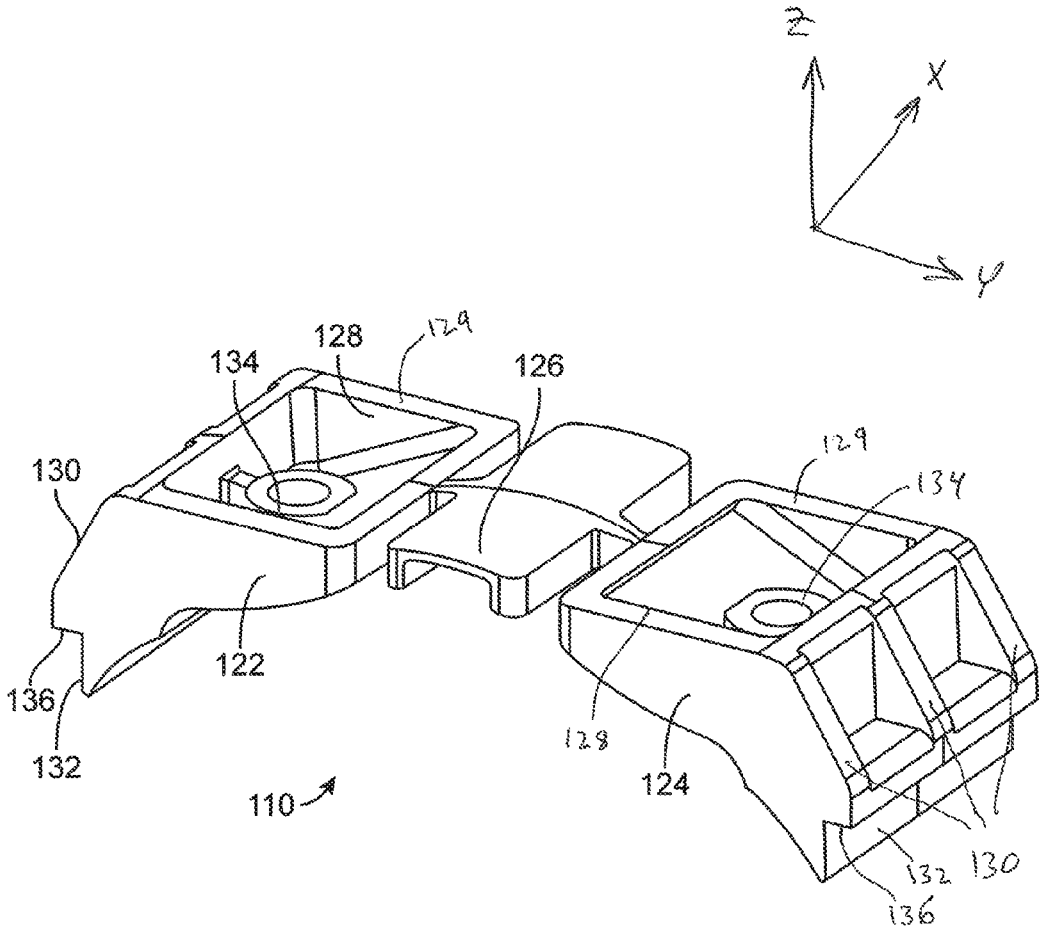
FIG. 3 and FIG. 4 illustrate perspective views of an attachment clip, according to an embodiment of the present invention.
Figure 4:
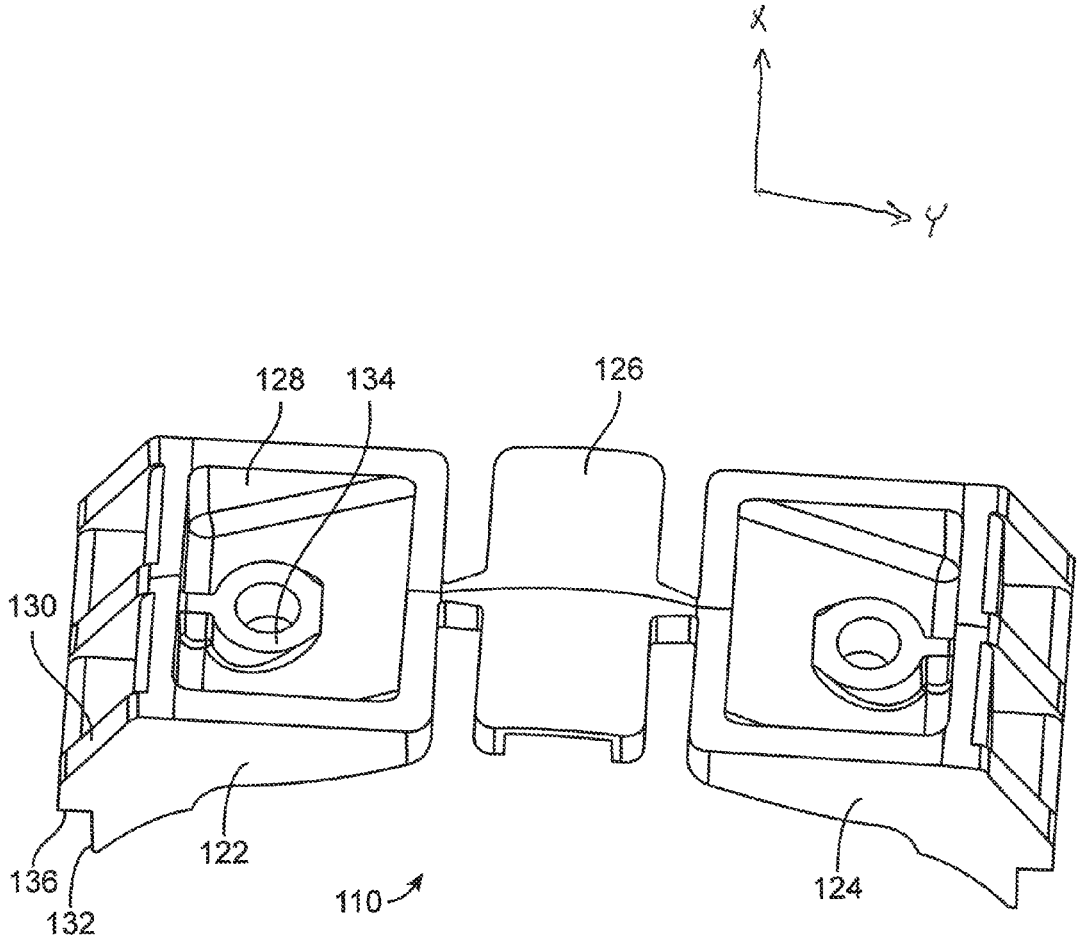

FIG. 3 and FIG. 4 illustrate perspective views of attachment clip 110. The XYZ coordinate directions are marked in the figures. Unless otherwise indicated, horizontal refers to a direction or plane parallel to the X-Y plane, and vertical refers to a direction or plane perpendicular to horizontal. In an embodiment of the present invention, attachment clip 110 provides a mounting interface between rail topper 108 and elongated rail 102. In an embodiment, width of attachment clip 110 is substantially equal to elongated rail 102. Those skilled in the art will appreciate that any other width of attachment clip 110 is also possible that can provide compact fitting of rail topper 108 and elongated rail 102.

In an embodiment of the present disclosure, attachment clip 110 includes a left portion 122, a right portion 124, and a middle portion 126 that connects left portion 122 with right portion 124. Middle portion 126 may be breakaway or not breakaway, either of which provides benefits that will be apparent below. In an embodiment, middle portion 126 is connected to left portion 122 and right portion 124 with a narrow physical interface such that it is easily breakable with the help of a screw driver (or any other edged or prying tool). In an embodiment, the width of middle portion 126 is chosen such that it provides desired lateral spacing between left portion 122 and right portion 124 so that the rail topper 108 is automatically self-centered on the elongated rail 102.

In an embodiment, left portion 122 includes a first planar surface 129 substantially parallel to the X-Y plane, a first inclined surface 130 that extends from first planar surface 129 to a first horizontal surface 136. First horizontal surface 136 extends from first inclined surface 130 to a first vertical surface 132. Some embodiments of left portion 122 may include a first cavity 128, such that first planar surface 129 forms at least a portion of a perimeter around first cavity 128. Left portion 122 may include a mounting hole 134 to receive a fastener (such as a screw). Mounting hole 134 and its fastener facilitate secure attachment of left portion 122 to elongated rail 102. In some embodiments, first inclined surface 130 facilitates sliding a portion of rail topper 108 over attachment clip 110 with minimal resistance when rail topper 108 is snapped onto attachment clip 110. Rail topper 108 may be snapped onto attachment clip 110 when a portion of rail topper 108 (e.g., a left flange) mates with first horizontal surface 136. In some embodiments, inclined surface 130 may have a curvature in the Y-Z plane.

Right portion 124 of attachment clip 110 is similar to the left portion and includes a second planar surface 129 substantially parallel to the X-Y plane, a second inclined surface 130 that extends from second planar surface 129 to a second horizontal surface 136. Second horizontal surface 136 extends from second inclined surface 130 to a second vertical surface 132. Some embodiments of right portion 124 may include a second cavity 128, such that second planar surface 129 forms at least a portion of a perimeter around second cavity 128. Right portion 124 may include a mounting hole 134 to receive a fastener (such as a screw). Mounting hole 134 and its fastener facilitate secure attachment of right portion 124 to elongated rail 102. In some embodiments, second inclined surface 130 facilitates sliding a portion of rail topper 108 over attachment clip 110 with minimal resistance when rail topper 108 is snapped onto attachment clip 110. Rail topper 108 may be snapped onto attachment clip 110 when a portion of rail topper 108 (e.g., a right flange) mates with second horizontal surface 136. In some embodiments, inclined surface 130 may have a curvature in the Y-Z plane.

In one embodiment of the present invention, attachment clip 110 is semi-flexible. In another embodiment, the left portion and right portion of attachment clip 110 are rigid and the middle portion is semi-flexible. Middle portion 126 is breakable with help of a screwdriver (or any other tool having edge) and creates space (void or groove) to receive the central ridge portion of rail topper 108. This allows rail topper 108 to come in direct contact with elongated rail 102 and the center of gravity of the rail topper 108 is lowered. This allows improved structural integrity and stability between elongated rail 102 and rail topper 108. Further, this allows self-centering of rail topper 108 over elongated rail 102. Furthermore, this prevents movement (for example, rotational or side movement) of rail topper 108 over elongated rail 102.

Figure 5:
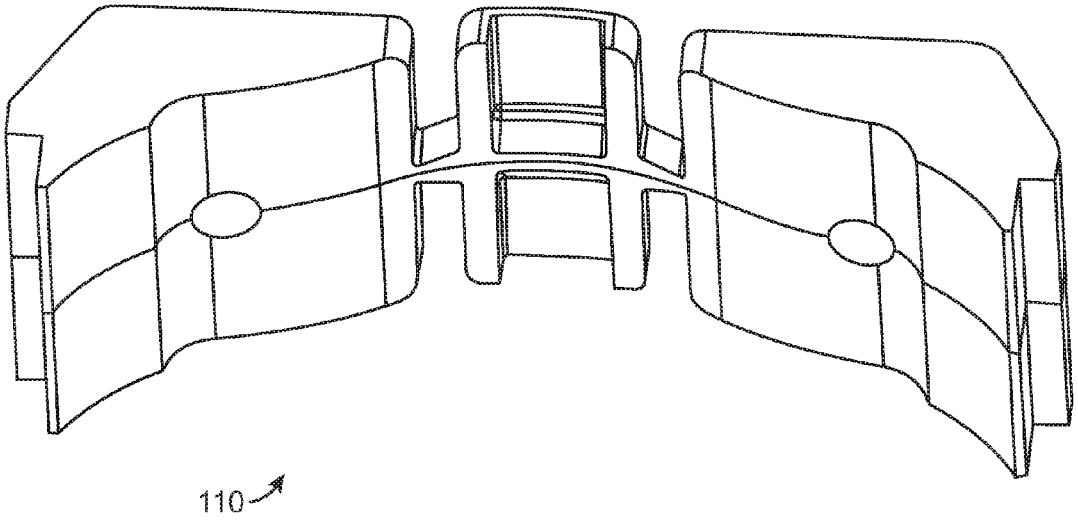
FIG. 5 illustrates a bottom view of the attachment clip, according to an embodiment of the present invention.
Figure 6A:
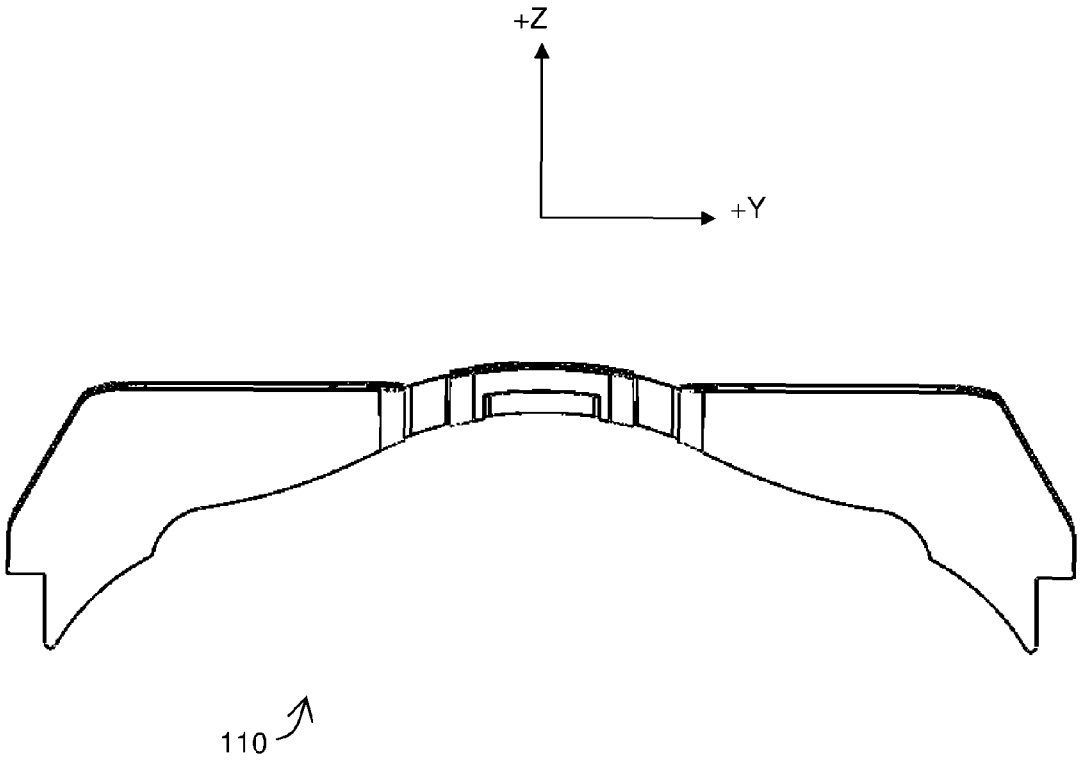
FIG. 6A illustrates a side view of the attachment clip, according to an embodiment of the present invention.
Figure 6B:
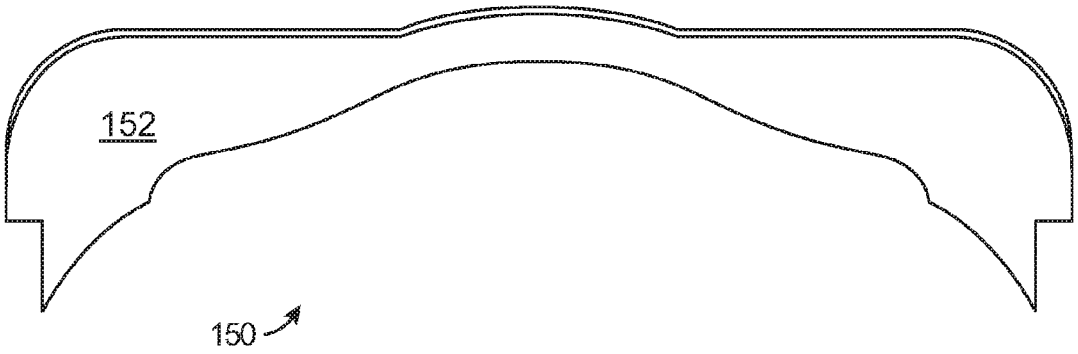
FIG. 6B illustrates a side view of another embodiment of an attachment clip, according to an embodiment of the present invention.

FIG. 5 and FIG. 6A illustrate bottom view and side view of attachment clip 110 for railing assembly, respectively. FIG. 6B illustrates a side view of another attachment clip 150, in which a central portion of the attachment clip 150 is not designed to be removable. Attachment clip 150 may be a single body such that attachment clip 150 includes a side surface 152 that extends from the left side of attachment clip 150 to the right side of attachment clip 150.

Figure 7:
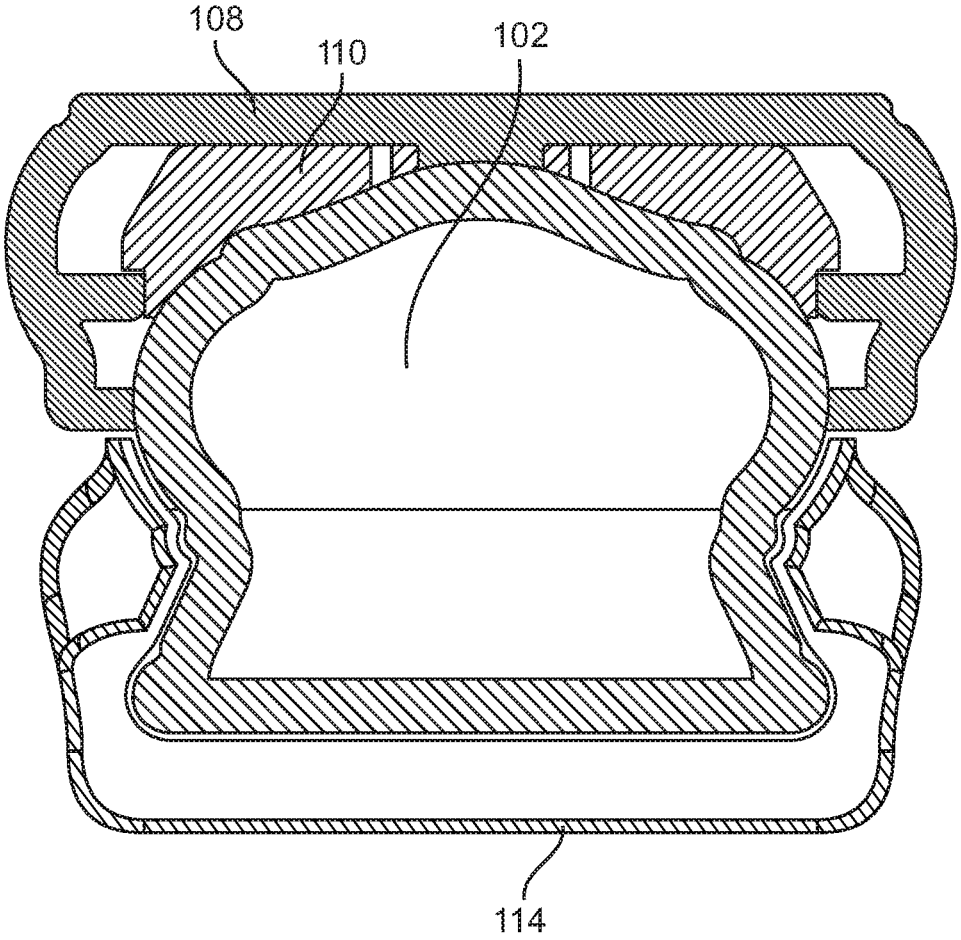
FIG. 7 illustrates a cross-sectional view of railing system after assembly of the rail topper and the attachment clip over elongated rail, according to an embodiment of the present invention.

FIG. 7 illustrates a cross-section view of rail topper 108 snap-fitted over elongated rail 102 with help of attachment clip 110. As shown in the figure, the central ridge portion of rail topper 108 stays intact with the left portion and the right portion of attachment clip 110 even after installation. Further, top surface of attachment clip 110 is contoured to the bottom surface of the semi-flexible rail topper 108. As illustrated, the central ridge portion protrudes up, and mates with a depression or void in the bottom surface of the semi-flexible rail topper 108.

In an embodiment of the present invention, attachment clip 110 includes left portion 122, right portion 124, and the middle portion 126, as described above. In another embodiment of the present invention, attachment clip 110 may include only the left portion 122 or the right portion 124. In this embodiment, a single-piece clip may be installed on each of the left side and right side of elongated rail 102. The single-piece clip is equivalent to the left portion 122 or right portion 124 of attachment clip 110 described above, and the single-piece clip does not include the middle portion 126, and there is no middle portion to be broken. Separate left portions 122 or right portions 124 may be installed independently of each other, e.g., at least one each but in unequal numbers, or at staggered locations along elongated rail 102, and so forth.

Figure 8:
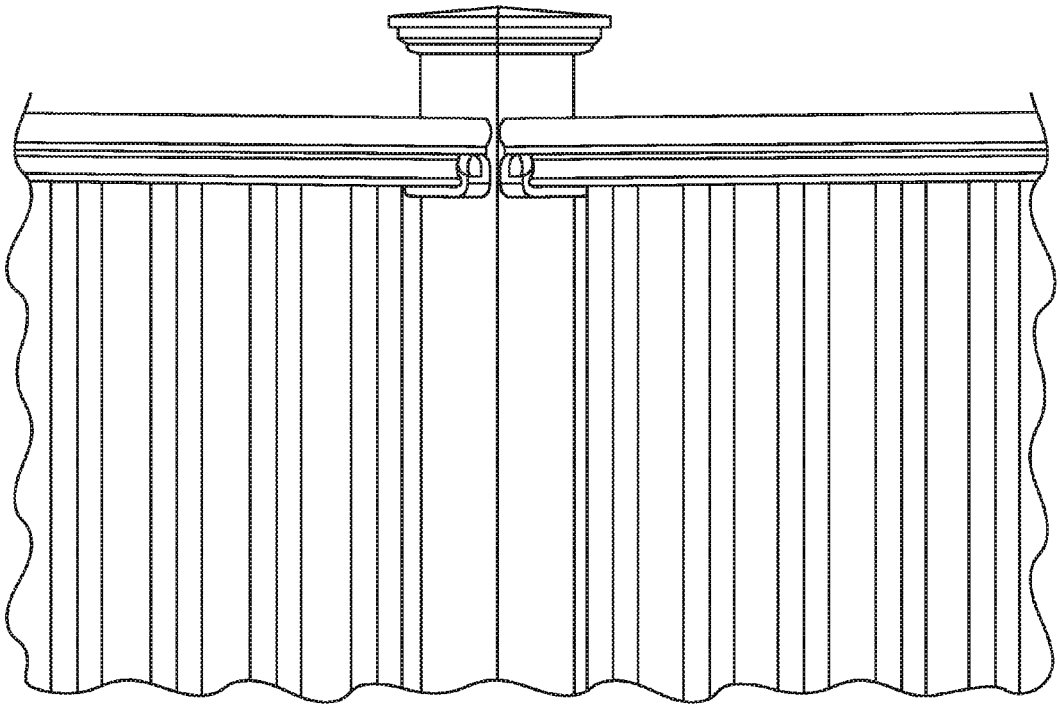
FIG. 8 illustrates a perspective view of the railing system after assembly of the rail topper and the attachment clip over the elongated rail, according to an embodiment of the present invention.

FIG. 8 illustrates perspective view of an assembled railing system 800. As shown in the figure, attachment clip 110 is not visible as it has been concealed by rail topper 108 and elongated rail 102. Rail topper 108 has been snap-fitted on top of the elongated rail 102 with support of attachment clip 110. Rail topper 108 sits on top of elongated rail 102 and substantially encloses elongated rail 102. As shown in the figure, elongated rail 102 is also connected to a post 106 with support of the side cover and the bracket cover.

Figure 9:
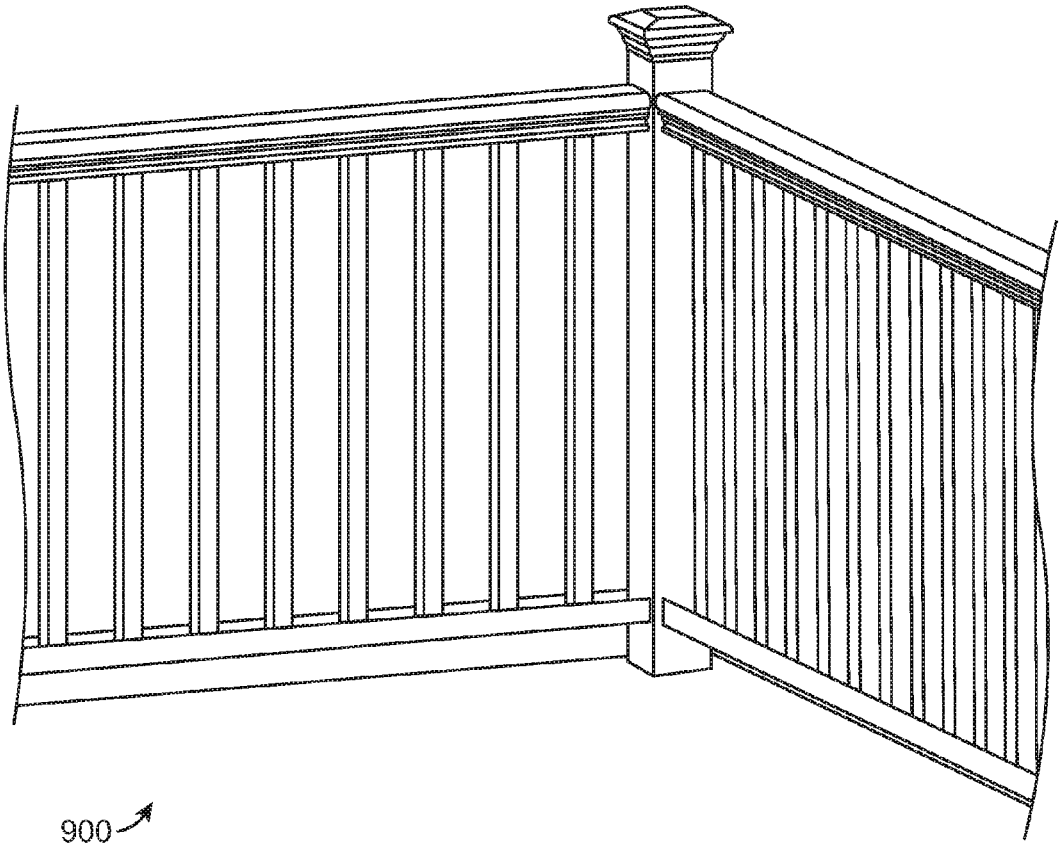
FIG. 9 illustrates another perspective view of the railing system after assembly of the rail topper and the attachment clip over the elongated rail, according to an embodiment of the present invention.

FIG. 9 illustrates perspective views of yet another assembled system 900. As shown in the figure, balusters connect the elongated upper rail with the elongated bottom rail. Rail topper 108 has been snap-fitted over the elongated upper rail with help of attachment clip 110, and attachment clip 110 is not visible. As shown in the figure, rail topper 108 provides attractive and unique aesthetic appearance to the railing system. Further, rail topper 108 is detachable and a different rail topper 108 having different color or design may be snapped over the upper elongated rail when desired by a user.

Figure 10:
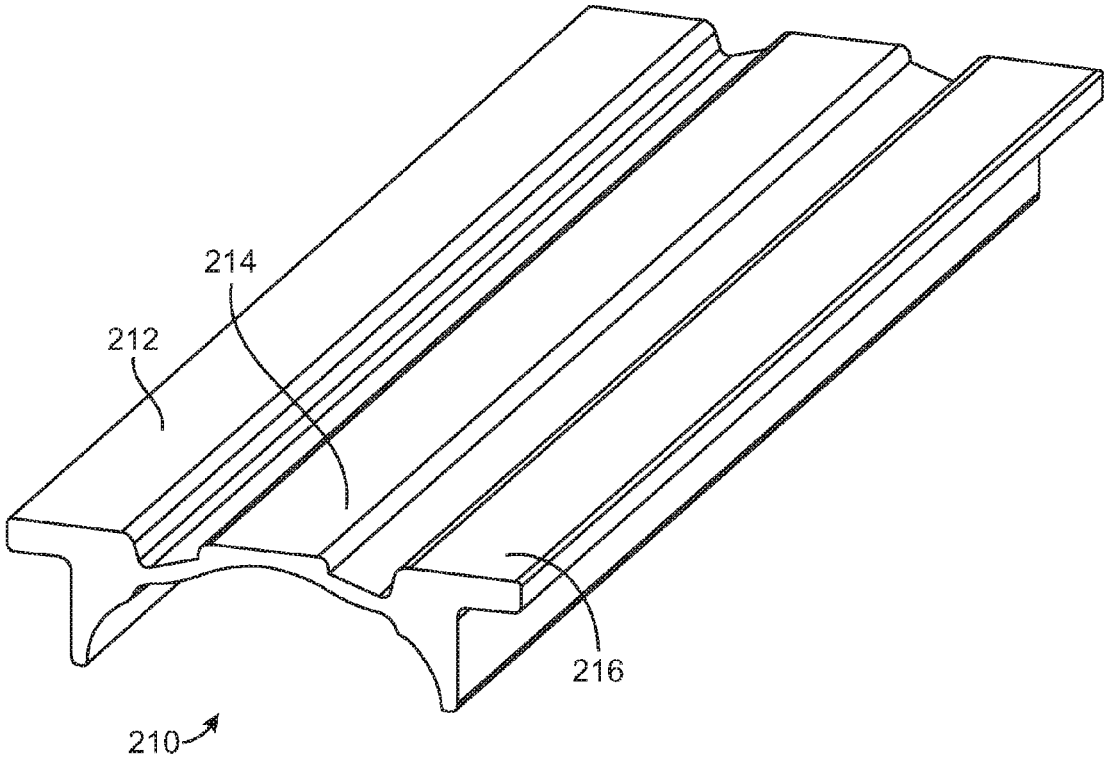
FIG. 10 illustrates a perspective view of an attachment clip, according to another embodiment of the present invention.
Figure 11:
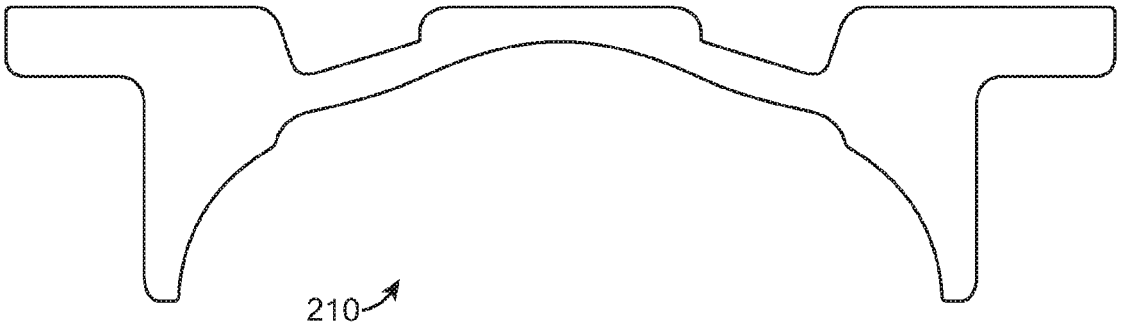
FIG. 11 illustrates a side view of the attachment clip shown in FIG. 10, according to an embodiment of the present invention.

FIG. 10 and FIG. 11 illustrate a perspective view and side view of an attachment clip 210, respectively, according to another embodiment of the present invention. In this embodiment, attachment clip 210 includes a left side flat portion 212, a middle flat portion 214, and a right side flat portion 216. Middle flat portion 214 is connected to left side flat portion 212 through a first curved portion, and to right side flat portion 216 through a second curved portion, as shown in FIGS. 10 and 11. The first curved portion and the second curved portion may include mounting holes to receive fasteners (for example, screws) to fix attachment clip 210 to elongated rail 102. In this embodiment of the present invention, attachment clip 210 has an elongated structure, and middle flat portion 214 is not broken or removed after attaching attachment clip 210 to elongated rail 102 (unlike attachment clip 110). Flat middle portion 214 may be made of same material as left side flat portion 212 and right side flat portion 216. Those skilled in the art will appreciate that although attachment clip 210 has been drawn as having a significant length in the X-axis direction, a significant length may be not be necessary in some embodiments.

Figure 12:
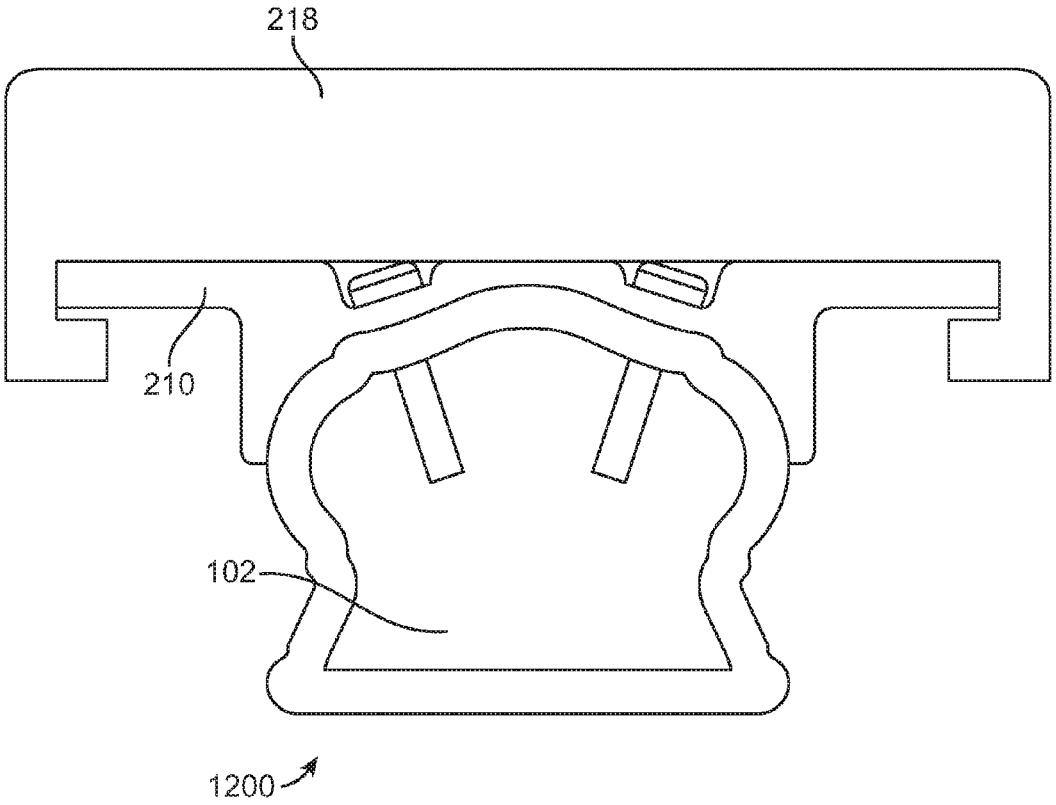
FIG. 12 illustrates a side view of the railing system after assembly of the rail topper and the attachment clip over the elongated rail, according to an embodiment of the present invention.

FIG. 12 illustrates a side view of a rail topper member 218 snapped over attachment clip 210, in railing system 1200, according to an embodiment of the present invention. Attachment clip 210 may be screwed to elongated rail 102 by use of screws extending through mounting holes of attachment clip 210. Further, rail topper member 218 includes a left flange and right flange that engages with the left portion and the right portion of attachment clip 210, respectively and facilitates locking rail topper member 218 to attachment clip 210. Rail topper member 218 is locked to attachment clip 210 sufficiently to prevent significant unintended movement of rail topper member 218 either left/right (i.e., +/−Y-axis as illustrated in the figures) or up/down (i.e., +/−Z-axis as illustrated in the figures). A significant movement is at least one that may cause rail topper member 218 to disengage from attachment clip 210, and the movement is unintended if it is not made for the purpose of removing rail topper member 218 from attachment clip 210.

Figure 13:
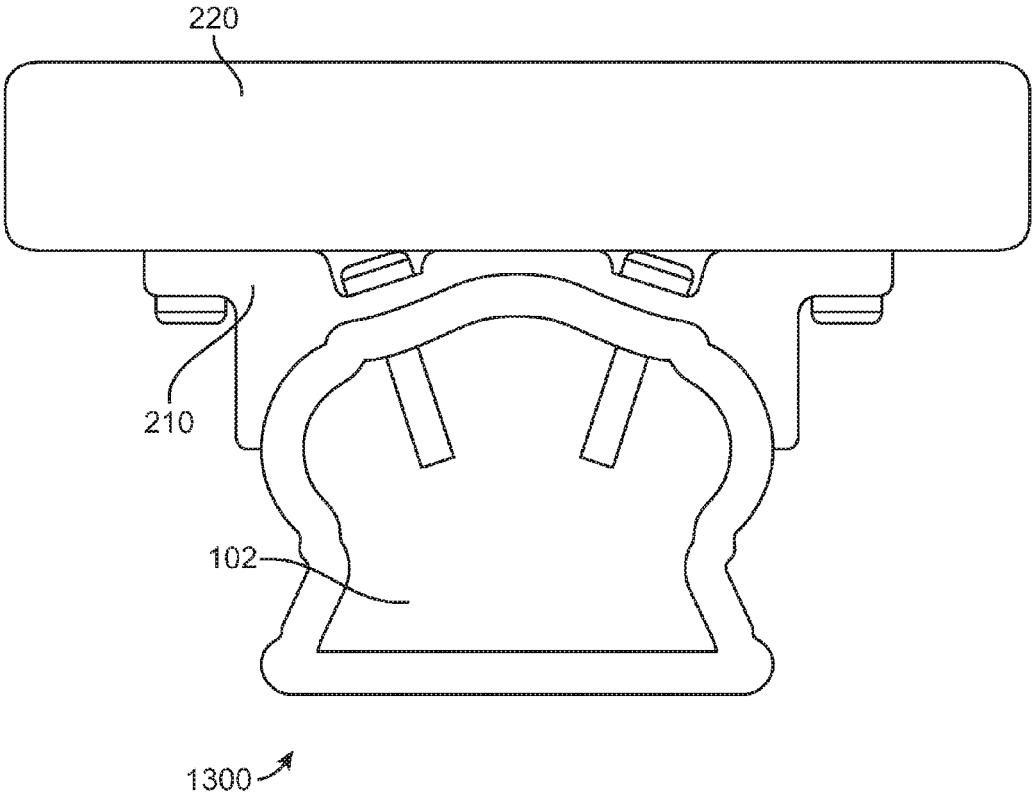
FIG. 13 illustrates a side view of the railing system after assembly of the rail topper and the attachment clip over the elongated rail, according to another embodiment of the present invention.
Figure 14:
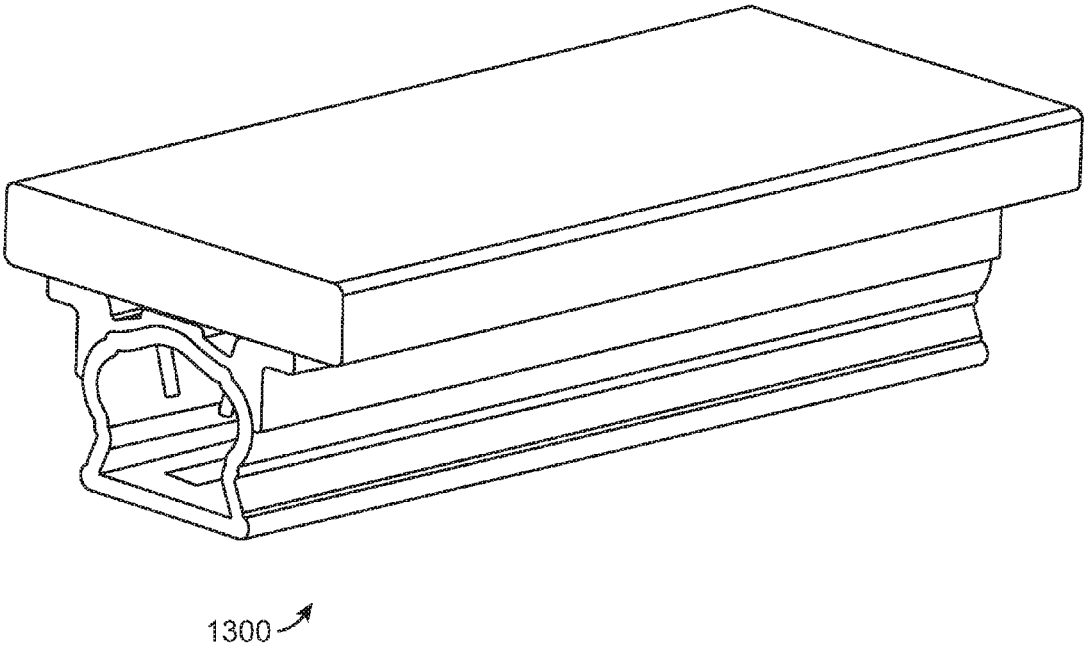
FIG. 14 illustrates a perspective view of the railing system after assembly of the rail topper and the attachment clip over the elongated rail shown in FIG. 13, according to an embodiment of the present invention.

FIG. 13 illustrates side view of a railing system 1300, in accordance with an embodiment of the present disclosure. System 1300 includes rail topper 220 rigidly fixed to attachment clip 210 using fasteners. FIG. 13 illustrates an elongated rail 102, an attachment clip 210, and a rail topper member 220. In this embodiment, rail topper member 220 has a central body elongated along the Z-axis (perpendicular to the plane of FIG. 13), having a rectangular top surface and a rectangular bottom surface. Further, rail topper 220 may be a rigid member, or may be a semi-flexible member in other embodiments. To assemble railing system 1300, attachment clip 210 first is fixed over elongated rail 102 with help of fasteners (such as screws) in mounting holes. In this embodiment, attachment clip 210 also includes mounting holes at each of the left side flat portion and the right side flat portion. Then, rail topper member 220 is coupled over and onto attachment clip 210 with help of fasteners (such as screws) in the mounting holes present on left side flat portion and the right flat portion. FIG. 14 illustrates a perspective view of rail topper 220 fixed over attachment clip 210 using fasteners, in railing system 1300. Those skilled in the art will appreciate that railing system 1300 is easily detachable as the fasteners can be locked and unlocked any time to change or upgrade rail topper 220.

Figure 15:
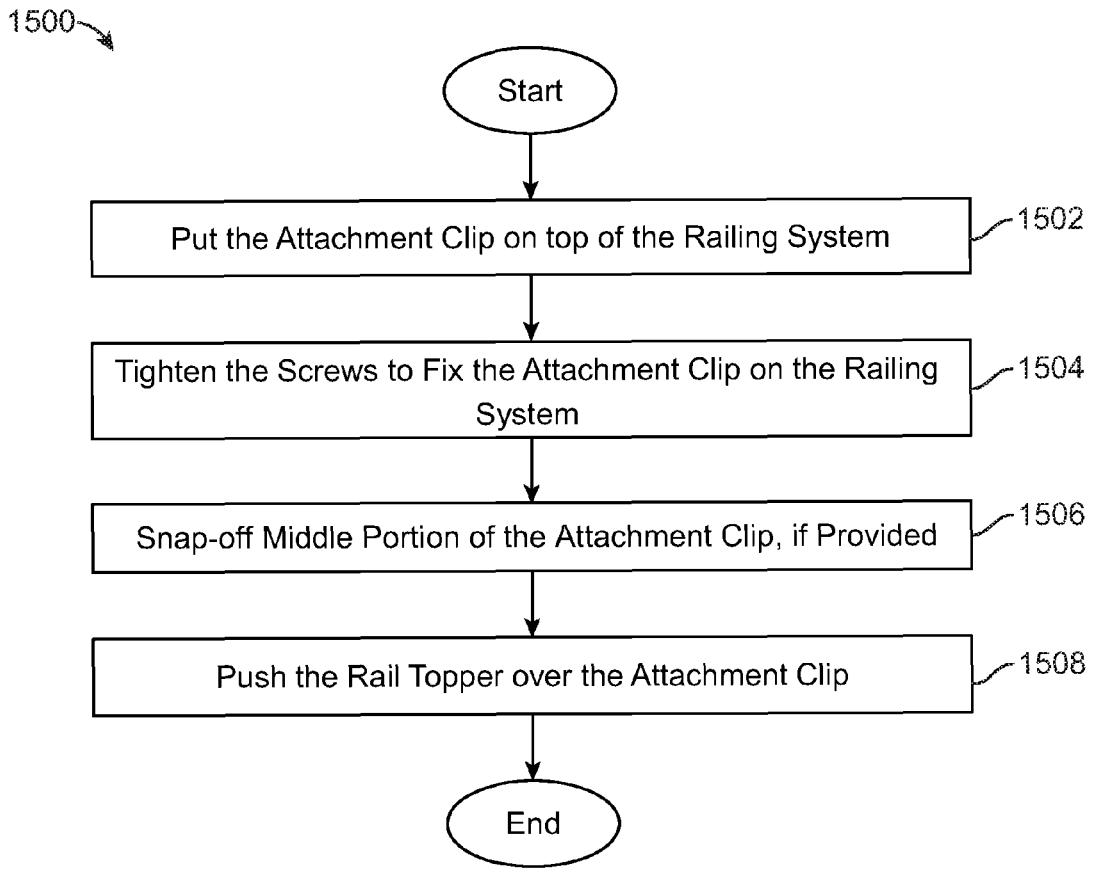
FIG. 15 depicts an exemplary flowchart illustrating a method of assembly of a rail topper over the railing system with help of the attachment clip, according to an embodiment of the present invention.

FIG. 15 illustrates an exemplary flowchart illustrating a method 1500 for operation of fixing a rail topper member (e.g., 108) over the railing system, according to an embodiment of the present disclosure.

Initially, at step 1502, attachment clip 110 (or 210) is placed on the railing system, and a place to drill the railings is marked corresponding to the two holes of attachment clip 110. The railings are then drilled at two marked places.

At step 1504, the fasteners (for example, screws) are tightened, which locks attachment clip 110 over and onto the railings. In an embodiment of the present invention, attachment clip 110 is fastened to elongated rail 102 using screws. Those skilled in the art will appreciate that in another embodiment, step 1502 and 1504 may be combined in a single step, where the attachment clip 110 may be fixed over the railing system through any other attachment means.

At optional step 1506, the middle portion (if provided) of an attachment clip may be broken off or snapped off. A middle portion may not be provided if the attachment clip includes separate, unconnected left and right portions. In an embodiment of the present invention, the middle portion if provided may be snapped off using a screwdriver or device having an edge that can engage with the middle portion and snap it off. Removal of the middle portion creates space (e.g., a void or groove) to receive the central ridge portion of rail topper 108. Step 1506 may be optional for clips such as attachment clip 210 that do not have a removable middle section.

At step 1508, rail topper 108 is snapped fit over attachment clip 110 and pushed. Rail topper 108 is pushed over attachment clip 110 so that it encloses the railing system and attachment clip 110. The central ridge portion of rail topper 108 makes direct contact with the top portion of the railings due to removal of the middle portion of attachment clip 110 in step 1506. The left side and right side flanges of rail topper 108 engages with edge portion of attachment clip 110 to lock rail topper 108 in a sound fit over elongated rail 102. The ridge portion of rail topper 108 can make contact more easily with the top portion of the railings when the middle portion of attachment clip 110 is snapped off. Hence, the center of gravity of rail topper 108 is lowered, thus providing improved structural integrity between rail topper 108 and the elongated rail 102.

The foregoing discussion of the present invention has been presented for illustration and description. It is not intended to limit the present invention to the form or forms disclosed herein. In the foregoing detailed description, for example, various features of the present invention are grouped together in one or more embodiments, configurations, or aspects to streamline the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this detailed description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A railing attachment clip to couple a guardrail to a rail topper, the clip comprising:

a left portion comprising:

a first mating surface contoured to match a first portion of the guardrail;

a second mating surface contoured to match a first portion of the rail topper; and an attachment area configured to facilitate attachment of the left portion to the guardrail;

a central portion laterally coupled to the left portion;

a right portion laterally coupled to the central portion, the right portion comprising:

a first mating surface contoured to match a second portion of the guardrail;

a second mating surface contoured to match a second portion of the rail topper; and an attachment area configured to facilitate attachment of the right portion to the guardrail, wherein the central portion separates the left portion from the right portion by a fixed distance, and wherein the central portion is detachably coupled to both the left portion and the right portion.

2. The railing attachment clip of claim 1, wherein the fixed distance is selected so that the first mating surface of the left portion is coupled to the first portion of the guardrail when the first mating surface of the right portion is coupled to the second portion of the guardrail, and so that the second mating surface of the left portion is coupled to the first portion of the rail topper when the second mating surface of the right portion is coupled to the second portion of the rail topper.

3. The railing attachment clip of claim 1, wherein the central portion comprises a mating surface contoured to match a third portion of the rail topper.

4. The railing attachment clip of claim 1, wherein the central portion comprises a detachable body having a shape that matches a central ridge of the rail topper.

5. The railing attachment clip of claim 4, wherein the central ridge of the rail topper comprises a surface contoured to match a third portion of the guardrail.

6. The railing attachment clip of claim 5 wherein, when the rail topper is coupled to the guardrail, the central ridge is in contact with the left portion and the right portion of the railing attachment clip.

7. The railing attachment clip of claim 1, wherein the first mating surface of the left portion and the first mating surface of the right portion comprise respective non-planar surfaces.

8. The railing attachment clip of claim 1, wherein the second mating surface of the left portion and the second mating surface of the right portion comprise respective snap-fit surfaces.

9. The railing attachment clip of claim 1, wherein the second mating surface of the left portion and the second mating surface of the right portion comprise respective planar surfaces.

10. A method to couple a guardrail to a rail topper, the method comprising:

providing an attachment clip comprising a left portion, a central portion laterally coupled to the left portion, and a right portion laterally coupled to the central portion, wherein the central portion separates the left portion from the right portion by a fixed distance;

positioning the attachment clip at a selected position, such that a first mating surface of the left portion of the attachment clip matches a first portion of the guardrail, and a first mating surface of the right portion of the attachment clip matches a second portion of the guardrail;

attaching the attachment clip to the guardrail when the attachment clip is at the selected position;

detaching the central portion of the attachment clip;

coupling a first portion of the rail topper to a second mating surface of the left portion of the attachment clip;

coupling a second portion of the rail topper to a second mating surface of the right portion of the attachment clip; and attaching the rail topper to the attachment clip when the second mating surface of the left and right portions are coupled to respective first and second portions of the rail topper.

11. The method of claim 10, wherein attaching the rail topper to the attachment clip comprises snap-fitting the rail topper to the attachment clip.

12. The method of claim 10, wherein attaching the rail topper to the attachment clip comprises fastening the rail topper to the attachment clip.

13. The method of claim 10, further comprising a step of fitting a central ridge of the rail topper to a void formed by removing the central portion of the attachment clip.

14. The method of claim 10, further comprising a step of preventing rotation of the rail topper around an axis perpendicular to a lateral direction separating the left and right portions of the attachment clip.

15. A railing system comprising:

an elongated rail comprising:

an elongated core member; and an attachment clip comprising:

a left side portion having a first concave portion, a first curved portion, and a first edge portion;

a right side portion having a second concave portion, a second curved portion, and a second edge portion; and a middle portion connecting the first concave portion of the left side portion with the second concave portion of the right side portion; and a rail topper member comprising an elongated central body having a pair of opposing side walls defining a channel to receive the elongated core member, the rail topper member having a central ridge portion, at least one left flange on left side wall, and at least one right flange on right side wall;

wherein the middle portion of the attachment clip is breakable, and the rail topper member is snap-fitted over the attachment clip after breaking the middle portion of the attachment clip, wherein the central ridge portion of the rail topper member contacts an upper portion of the elongated core member, and wherein the left flange of the rail topper member engages with the first edge portion of the attachment clip and the right flange of the rail topper member engages with the second edge portion of the attachment clip to lock the rail topper member over attachment clip and the elongated rail.

* * * * *